US005803316A

United States Patent [19]

Couture

[11] Patent Number: 5,803,316

[45] Date of Patent: Sep. 8, 1998

[54] ADD-ON PARTITION SYSTEM TO BE REMOVABLY MOUNTED INSIDE A PITCHER

[76] Inventor: Gilles Couture, 7580 Béique, Montréal, Qc, Canada, H4K 1A3

[21] Appl. No.: 730,399

[22] Filed: Oct. 15, 1996

[51] Int. Cl.[6] ..... B67D 5/58

[52] U.S. Cl. ..... 222/189.07; 222/189.06

[58] Field of Search ..... 222/189.06, 189.07, 222/190, 465.1

[56] References Cited

U.S. PATENT DOCUMENTS

| | | | |
|---|---|---|---|
| 1,177,953 | 4/1916 | Iverson | 210/467 |
| 1,280,625 | 10/1918 | Allensworth | 210/466 |
| 1,357,744 | 11/1920 | Taub | 222/189.07 |
| 2,183,773 | 12/1939 | Lehman | 222/189.07 |
| 2,990,981 | 7/1961 | Schmitt et al. | 222/564 |
| 3,752,320 | 8/1973 | Biro | 210/469 |
| 4,523,699 | 6/1985 | Branscum | 222/189 |
| 4,655,373 | 4/1987 | Essen | 222/465.1 |
| 4,957,224 | 9/1990 | Kessler et al. | 222/465.1 |
| 5,158,216 | 10/1992 | Viani | 222/465.1 |
| 5,246,149 | 9/1993 | Broitzman | 222/465.1 |
| 5,289,953 | 3/1994 | McMillan, III et al. | 222/189 |
| 5,379,914 | 1/1995 | Martins | 220/719 |

FOREIGN PATENT DOCUMENTS

| | | | |
|---|---|---|---|
| 991602 | 10/1951 | France | 210/467 |
| 456529 | 2/1928 | Germany | 222/189.07 |

*Primary Examiner*—Andres Kashnikow
*Assistant Examiner*—Keats Quinalty
*Attorney, Agent, or Firm*—Antoine H. Gauvin

[57] ABSTRACT

A partition system to be added inside a pitcher. The system comprises an elongated partition plate having longitudinal sides, and a releasable hook. The hook is mounted inside the pitcher, adjacent to that portion of the walls of the pitcher terminating into a pouring lip, for temporary holding the partition plate adjacent to that portion of the walls of the pitcher and parallel to those walls. Thus inside the pitcher two zones are obtained:

a zone regulating the size of material leaving the pouring lip and thereby preventing oversize material, and a confinement zone for confining the oversize material in the confinement zone.

20 Claims, 10 Drawing Sheets

ADD-ON PARTITION SYSTEM TO BE REMOVABLY MOUNTED INSIDE A PITCHER

BACKGROUND OF THE INVENTION

1. Field of the Invention

This invention relates to an add-on partition system to be removably mounted inside a conventional pitcher.

This invention relates in particular to such an add-on partition system having a releasable hook means, said releasable hook means to be releasably mounted inside said pitcher, adjacent to a portion of the walls of the pitcher terminating into a pouring lip and lacking such a partition.

2. Description of Related Art

U.S. Pat. No. 2,990,981, dated Jul. 4, 1961, as invented by Schmitt et al, describes an ice bridge sealed to the edge of a top opening, and spaced inwardly from the pouring lip of a pitcher. The ice in front of this ice bridge, undoubtedly clogs or slows down the flow causing erratic or uneven stream and splashes.

U.S. Pat. No. 5,158,216, dated Oct. 27, 1992, as invented by Viani, describes a pitcher having an unperforated partition plate fixedly mounted inside a pitcher for keg or draft beer or soda. This plate must be sealed to the pitcher as otherwise the foam will sip through any space between the plate and the pitcher. As a matter of fact, Column 3, line 46 of the Patent refers to a molding process. This partition renders difficult cleaning between the plate and the wall of the pitcher.

U.S. Pat. No. 5,289,953, dated Mar. 1, 1994, as invented by McMillan III et al, describes a specially designed pitcher having chutes obtained from two edge walls. A strainer is either removably mounted to the front chute or part of the sidewalls. The manner of obtaining a removably mounted strainer being left to conjecture, but being obtained from the design of the pitcher for that purpose.

Other specially designed pitchers have been described in: U.S. Pat. No. 4,523,699, dated Jun. 18, 1985, as invented by Branscum; U.S. Pat. No. 5,246,149, dated Sep. 21, 1993, as invented by Broitzman; U.S. Pat. No. 4,957,224, dated Sep. 18, 1990, as invented by Kessler et al; and U.S. Pat. No. 4,655,373, dated Apr. 7, 1987, as invented by Essen. Also a filter for drinking containers is described in U.S. Pat. No. 5,379,914, dated Jan. 10, 1995, as invented by Martins. Thus all the known partitions are in a pitcher designed with the partition.

As far as Applicant is aware, there is no known add-on partition system that may be purchased as such, to be removably mounted inside a conventional pitcher, and even less to such partition system that may fit most of the pitchers that are not provided with partition systems.

BRIEF SUMMARY OF THE INVENTION

The aim of this invention is to provide an add-on partition system that may be purchased as such, to be removably mounted inside a conventional pitcher, at will.

Broadly stated the invention is directed to an add-on partition system to be removably mounted inside a pitcher having a bottom and walls upwardly extending therefrom and said walls upwardly extending terminating into an uppermost portion, a portion of said uppermost portion of said walls defining a pouring lip, a portion of said walls upwardly extending being on one side of said pouring lip and spaced therefrom, and another portion of said walls upwardly extending being on the other side of said pouring lip and spaced therefrom, and a portion of said walls upwardly extending being an intermediate portion between said portion of said walls upwardly extending on one side of said pouring lip, and said another portion of said walls upwardly extending on the other side of said pouring lip, and adjacent to said pouring lip, comprising:

an elongated partition plate inside said pitcher, said elongated partition plate having longitudinal sides, said longitudinal sides having a length, and the space between said longitudinal sides defining the width of said elongated partition plate, said elongated partition plate being spaced from said intermediate portion of said walls upwardly extending so as to divide said inside of said pitcher into two zones, one of said two zones being a reservoir zone for quick liquid delivery from said reservoir zone to said pouring lip, one of said longitudinal sides of said elongated partition plate to be held adjacent to said portion of said walls upwardly extending on one side of said pouring lip and distant from said pouring lip, and the other of said longitudinal sides of said elongated partition plate to be held adjacent to said portion of said walls upwardly extending on the other side of said pouring lip and distant from said pouring lip, the length of said longitudinal sides being such that the elongated partition plate extends adjacent from the bottom of the pitcher to said uppermost portion of said walls defining said pouring lip, thus said elongated partition plate defining said two zones inside said pitcher:

said reservoir zone between said elongated partition plate and said intermediate portion of said walls upwardly extending adjacent to said pouring lip, and a confinement zone for confining any oversize material therein, and releasable hook means, said releasable hook means to be releasably mounted to said walls upwardly extending of said pitcher, inside said pitcher, for releasably holding said elongated partition plate spaced from said intermediate portion of said walls upwardly extending to provide for said reservoir zone and said confinement zone.

Further embodiments of the invention will be described herein below.

DESCRIPTION OF THE DRAWINGS

In the drawings which illustrate some of the preferred ways of carrying out the invention.

DETAILED DESCRIPTION

Figure 1:
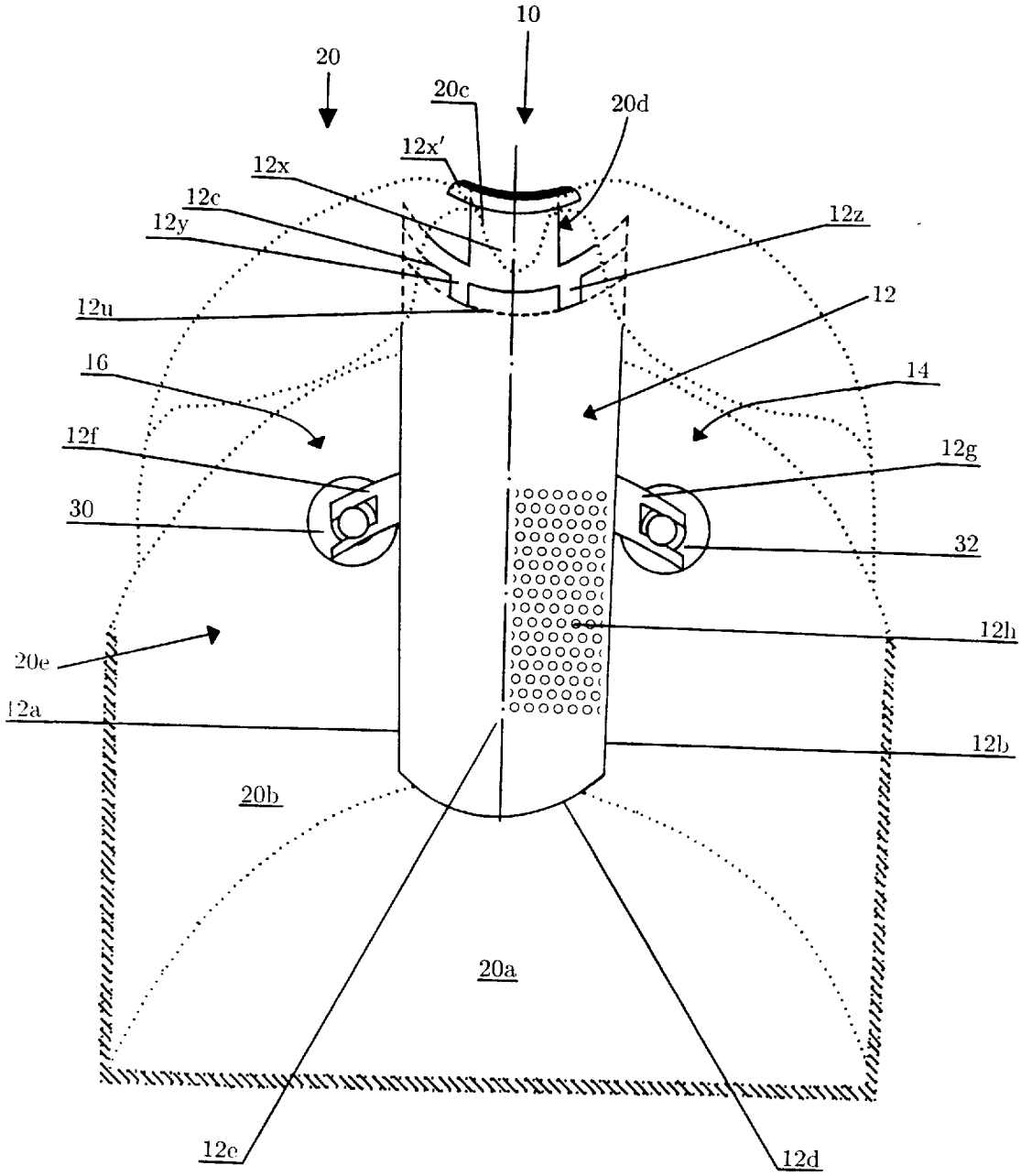
FIG. 1 is an inside perspective view of a pitcher shown in dotted lines but with the rear cut-off for sake of clarity, with an add-on partition system removably mounted inside the pitcher having a bottom and walls upwardly extending therefrom and having a portion of said walls terminating into a pouring lip, with a suction cup.
Figure 2:
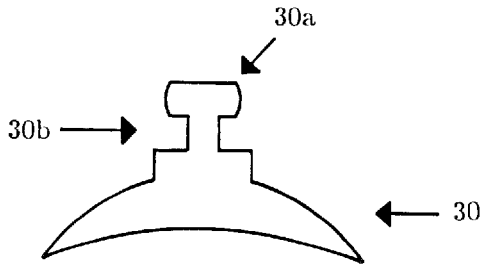
FIG. 2 is a side view of one of the suction cups of FIG. 1.

As shown in FIGS. 1 and 2, an add-on partition system 10 is removably mounted inside a pitcher 20 having a bottom 20*a* and walls 20*b* upwardly extending therefrom, a portion of the walls 20*b* generally terminating into a pouring lip 20*c* in order to ease pouring.

This add-on partition system 10 comprises:

an elongated partition plate 12 having longitudinal sides 12*a*, 12*b*, and a releasable hook means 14, 16, the releasable hook means to be releasably mounted to the walls of a pitcher, inside the pitcher, (for instance walls 20*b* inside pitcher 20) for releasably holding said partition plate 12 adjacent to said portion of said walls of said pitcher terminating into a pouring lip 20*c*, generally terminating into a pouring lip, which is generally but needs not be substantially parallel to the walls 20*b*, as to define inside the pitcher, a zone 20*d* regulating the size of material leaving the pouring lip 20*c*, and thereby preventing oversize material, and a confinement zone 20*e* for confining the oversize material in the confinement zone. The confinement zone 20*e* is defined in other words, by the pitcher content less the zone 20*d* regulating the size of material leaving the pouring lip 20*c*.

The partition plate as well as the releasable hook means may take numerous shape and embodiments. The hook means embrace suction cups having a hook, magnets with and without hook, hooks with a coil spring, hooks with other releasable fastening devices, for instance pins, as will be discussed herein below. These releasable hook means enable a thorough cleaning of pitchers giving access to all parts of pitchers, in order to eliminate contamination, particularly bacterial contamination. With permanent partition plates, cleaning is at least difficult, if not impossible. Also as partition plates are required only in some special circumstances, pitchers can be used without, when appropriate, which is often more aesthetical. Also with these removably mounted partition plates, one is not restricted in purchasing, to select pitchers with partition plates, but can select according to shapes, colour and the like without any concern of partition plates.

In a particular embodiment as shown in FIG. 1, the partition plate 12 is a rectangular plate defining opposite lateral sides 12*c*, 12*d* and said longitudinal sides 12*a*, 12*b*, and being hemicircularly bent as to obtain substantially U-shaped lateral sides 12*c*, 12*d*.

In another embodiment, the partition plate is a two-part plate: the partition plate 12 as defined above and another separate plate which may be slidably mounted as will be discussed herein below or added. For instance, an extension or part 12*x*, having peripheral projections or tongues 12*y*, 12*z* cut from the edge 12*u* of the part 12, as to squeeze the upper edge of the partition plate 12, between the edge such as 12*u* and the projections or tongues such as 12*y*, 12*z*. These projections or tongues could also inversely be made or provided in the plate 12 instead of in the extension or part 12*x*. Thus the partition plate is a two-part partition plate, one part being slidably mounted into the other part.

The extension or part 12*x* may also be provided with an outwardly projected lip 12*x*' for retaining ice or other solids.

In a preferred embodiment, the partition plate is an elongated rectangular plate having a symmetrical longitudinal axis partly shown at 12*e*, the partition plate defining lateral sides 12*c*, 12*d* and said longitudinal sides 12*a*, 12*b*, and at least one U-shaped tongue along each of the longitudinal sides, for instance 12*f*, 12*g*, the tongues being symmetrically disposed with respect to the symmetrical longitudinal axis 12*e* of the rectangular plate in pairs.

In a particular embodiment, the releasable hook means is a pair of suction cups, 30, 32; each suction cup, for instance 30 better shown in FIG. 2, defines a projection 30*a* having a groove 30*b* for receiving therein one of said U-shaped tongues 12*f*, 12*g*, and the cup of said suction cups to be releasably mounted to the walls of the pitcher, inside said pitcher, as shown for instance in FIG. 1.

The term "wall", when referred to pitcher, throughout the specification including claims and disclosure, being meant to include ice bridge and the like, as being an extension of the wall of a pitcher, when such an ice bride is present.

Figure 3:
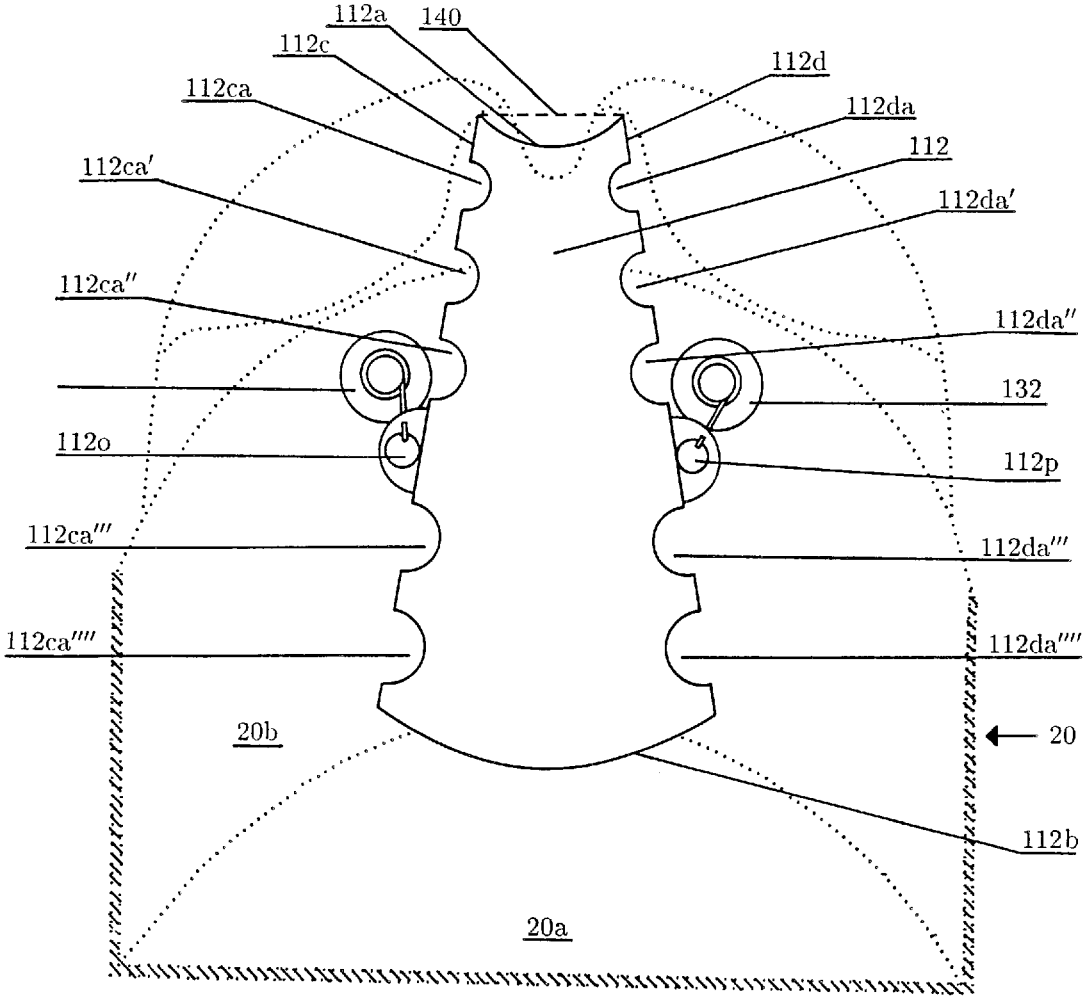
FIG. 3 is a view similar to FIG. 1, of a pitcher, but with another add-on partition system having different suction cups.

As shown in FIG. 3, in another embodiment using the same pitcher 20 for simplification sake as shown in FIG. 1, the partition plate 112 defines a truncated-cone shaped plate. The truncated-cone shaped plate has a truncated apex 112*a* and a base 112*b*, and is cut out by an imaginary plane such as shown at 140, running from the truncated apex 112*a* to the base 112*b*, as to define opposite longitudinal sides 112*c*, 112*d*.

In general, the partitions plates are preferably regularly or irregularly perforated as shown at 12*h* FIG. 1, and including screens and plates having a plurality of perforations or holes, preferably of the order of ¼ inch or less, but may also be unperforated:

When unperforated, the longitudinal sides of the partition plate are spaced from the walls of the pitcher to allow a gap whereby the size of material leaving the pouring lip is monitored and thereby preventing oversize material.

Instead, as shown in FIG. 3, at 112ca, 112ca', 112ca", 112ca'", 112ca"", and 112da, 112da', 112da", 112da'" and 112da"", the opposite longitudinal sides of the plate, may have a plurality of peripheral cut-off portions regularly or irregularly distributed along the longitudinal sides of the partition plate or have a plurality of arches in order to regulate the size of the material leaving the pouring lip and thereby preventing oversize material.

Figure 4:
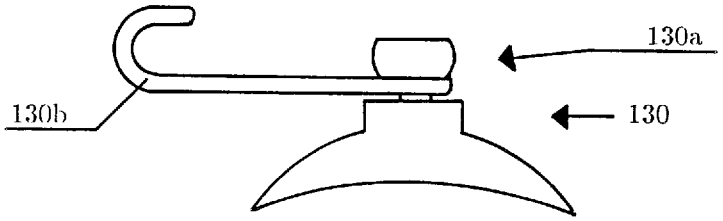
FIG. 4, next to FIG. 2, is a side view of one of the suction cups of FIG. 3, having a rotatable hook.

In FIG. 3, the releasable hook means may be a pair of suction cups as already discussed regarding 30, 32, (FIGS. 1 and 2) or other means. For instance, instead, that hook means may be a pair of suction cups 130, 132, each suction cup, for instance 130 better shown in FIG. 4, having a projection 130*a*, and a suspending hook 130*b* rotatably mounted about said projection 130*a*. In such a case, the partition plate 112 may be provided with perforations, orifices or openings, with a closed periphery, 112*o* and 112*p* for receiving said suspending hooks such as 130*b*. The suspending hooks such as 130*b* may be rounded or have other shapes.

Figure 5:
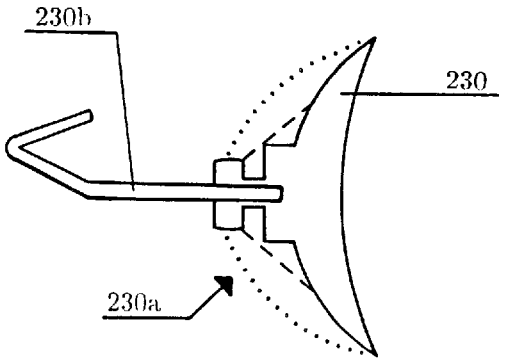
FIG. 5 is a side view of another kind of suction cups having a fixedly mounted hook.

In another embodiment, as shown in FIG. 5, if desired, the suction cups may be a pair of suction cups, each suction cup, for instance 230, having a projection 230*a*, and a suspending V-shaped hook 230*b* fixedly mounted in said projection 230*a*.

It should be noted that the plate may be mounted either fixedly or releasably to the suction cups adjacent to at least one of the sides of the plate.

Figure 6:
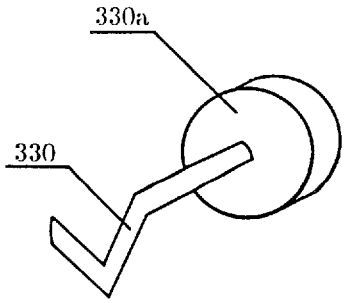
FIG. 6 is a perspective view of another hook terminating into a magnet.

If the wall, or part of the wall of a pitcher, or the pitcher is made up of, or has, a magnetic material or has at least a magnetic portion, the hooks may be such as the one shown in FIG. 6, with a suspending hook which terminates into a magnet such as 330*a*, the magnets replacing the suction cups such as 30, 130, 230, and thus the hooks so magnetized providing for the releasable hook means. This also means that whenever the partition plate defines at least one magnetic portion, said releasable hook means may simply be said at least one magnetic portion of said partition plate to be releasably mounted to the wall, or part of the wall, of the pitcher made up of a magnetic material, without suspending hook.

Thus when said partition plate is provided with perforations, said releasable hook means may be at least one pair of magnets terminating into a suspending hook, said suspending hooks engaging one of said perforations of said partition plate, said magnets for engaging said magnetic portion of said pitcher.

Also if desired, one end of a magnetic hooks may be threadedly mounted onto said magnet, or be press-fit. The magnet may even be perforated or have a cut out portion such as shown herein below.

Figure 7:
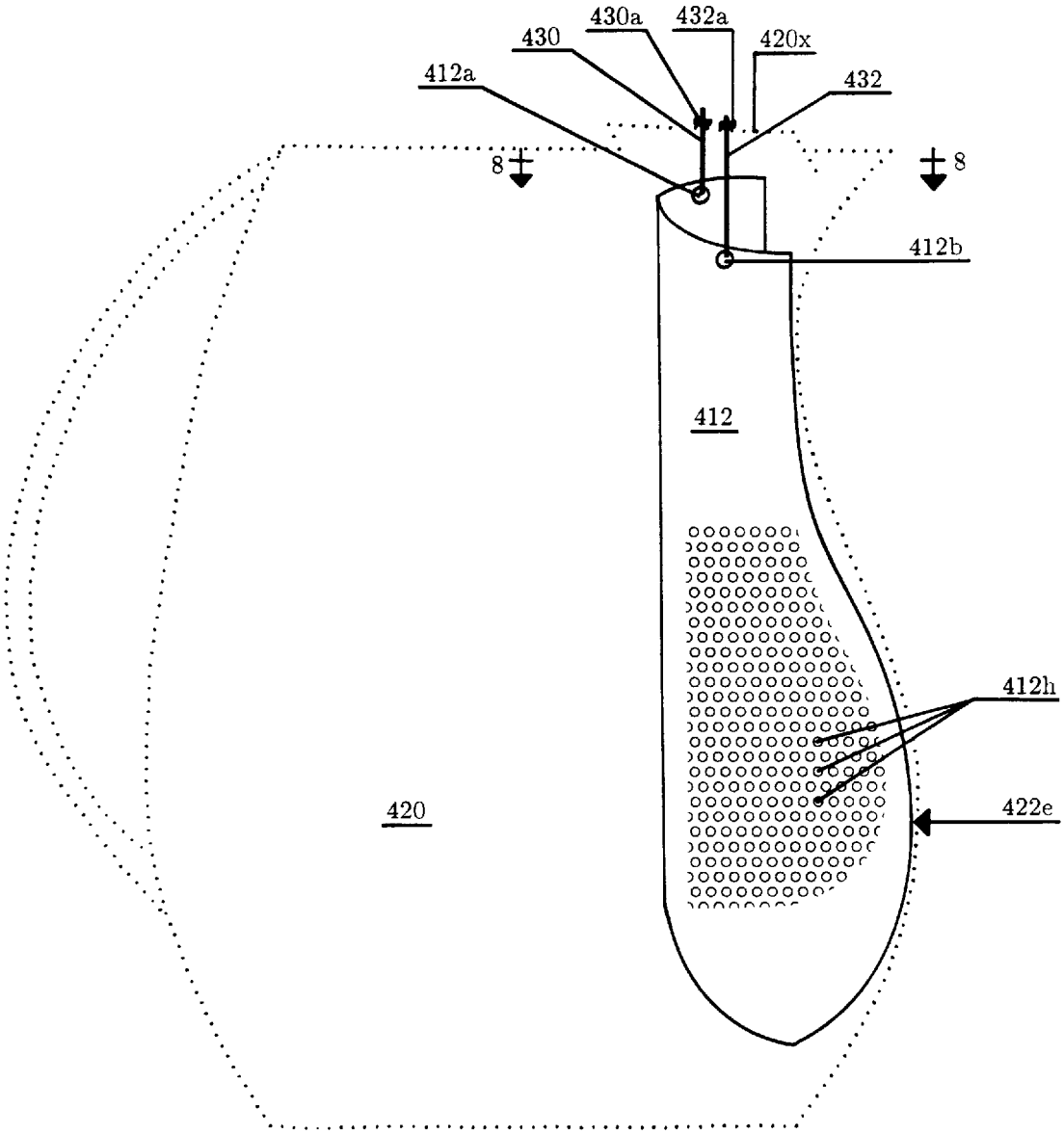
FIG. 7 is a side view of a pitcher having walls upwardly extending into an ice bridge, with another add-on partition system having a different releasable hook means and a partition plate with an enlarged bottom portion.
Figure 8:
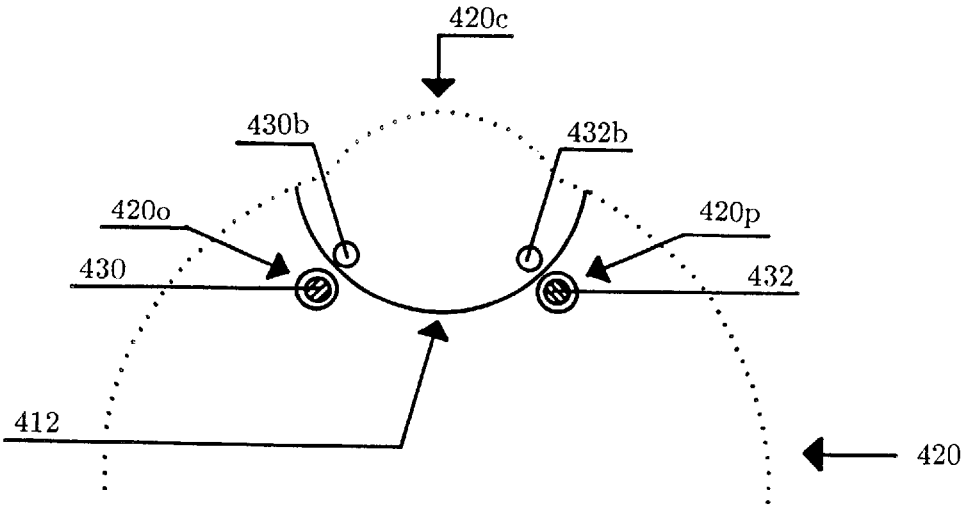
FIG. 8 is a top view taken along line 8—8 of FIG. 7, with the partition plate partly cut out.

As shown in FIGS. 7 and 8, a pitcher 420 has a bottom and wall upwardly extending therefrom, as to end into a pouring lip 420*c* and an ice bridge 420*x*. The ice bridge has slits, holes or perforations 420*o*, 420*p*. A hemicylindrically shaped or a V-shaped partition plate 412 having orifices or perforations such as 412*a*, 412*b*, or a plate of other shape, may be suspended with suspending hooks 430, 432 engaging orifices or perforations 412*a*, 412*b:*

Figure 9:
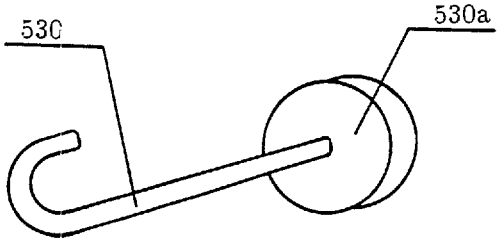
FIG. 9 is a perspective view of another kind of hooks having a magnetized end and acting as a different releasable hook means.

If the ice bridge 420*x* is made up of a magnetic material, hooks such as a suspending hook 530 which terminates into a magnet such as 530*a* (FIG. 9), may be used to be releasably held under the ice bridge.

Figure 10:
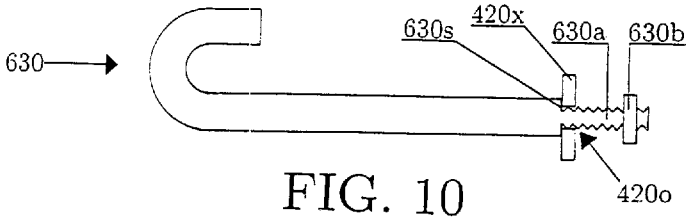
FIG. 10 is a side view of another kind of hooks having an end portion outwardly threaded.

When the ice bridge 420*x* is provided with orifices or perforations, for instance: 420*o* and 420*p* or more, (FIG. 8), as shown in FIG. 7 the end portion of the hooks of suspending hooks 430, 432, may be outwardly threaded to receive a nut 430*b*, 432*b*; or better shown in FIG. 10, the end portion of the hooks such as 630*a* of suspending hook 630 may be outwardly threaded to receive a nut 630*b*, whereby said one threaded end of said suspending hooks is able to engage one of said holes or perforations and be held therein with said nut.

Figure 11:
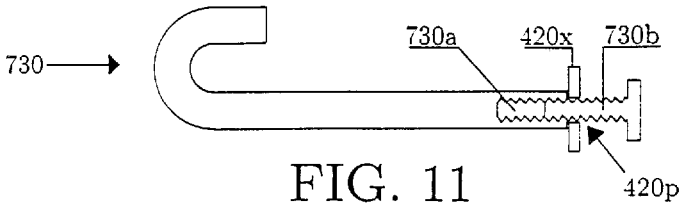
FIG. 11 is a side view of another kind of hooks having an end portion inwardly threaded.

Instead of the nuts such as 630*b*, shown in FIG. 10, the suspending hook 730 (FIG. 11), may have the end portion 730*a* inwardly threaded as to have a female threaded end, to receive a bolt 730*b* to be threadedly mounted into said threaded female end, and said ice bridge of said pitcher has at least two perforations, whereby said one threaded end of said suspending hooks is able to engage one of said perforations and be held therein with said bolt;

or hooks such as 430, 432 may be provided with a diametric hole to receive a pin for releasably holding the hooks to the pitcher as shown in FIGS. 7 and 8, as will be discussed in FIG. 18, the hooks thus floating and being pull down by gravity of the partition plate 412.

The hook such as 630*a* may each be provided with a retaining shoulder 630*s* and similarly for hooks such as 430, 432.

Also it should be borne in mind that the partition plate 412 needs not be regular, but may take other shapes. For instance being enlarged or widening in the lower portion as shown in FIG. 7 at 412*e*, if desired.

Figure 12A:
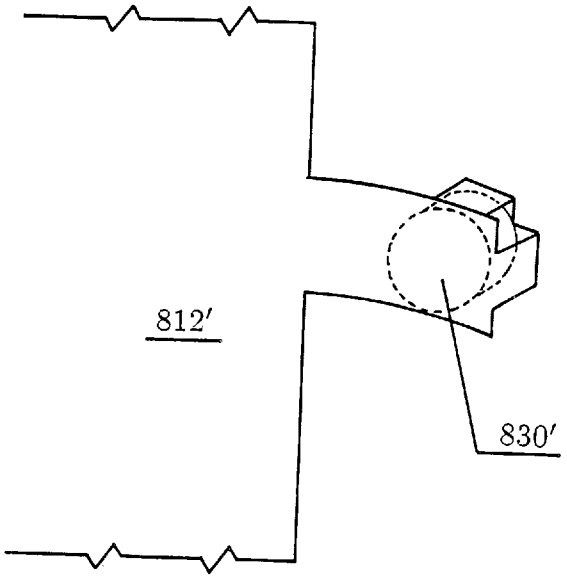
FIG. 12*a* is a schematic view of a part of a partition plate having integral therewith magnets.
Figure 12:
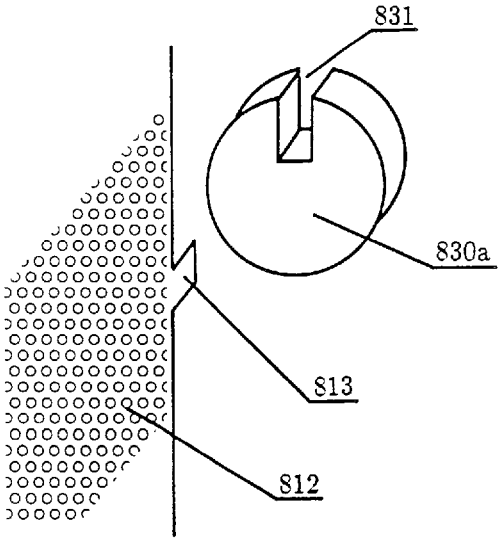
FIG. 12 is a schematic view of a part of a partition plate having a protrusion, tongue or peg, to be squeezed in a split magnetic hook defining a corresponding receiving female portion.

As shown in FIG. 12, the partition plate may simply be a flat plate such as 812 held with hooks, or male portions such as 813, engaging a magnet 830*a* having a slot or slit 831 for receiving each one of said hooks or male portions such as 813. Other male-female couplings or other fastening devices being also contemplated for bridging the magnets. Instead as shown in FIG. 12*a*, the partition plate 812' which is preferably plastic molded has integral therewith magnets such as 830'.

Figure 13:
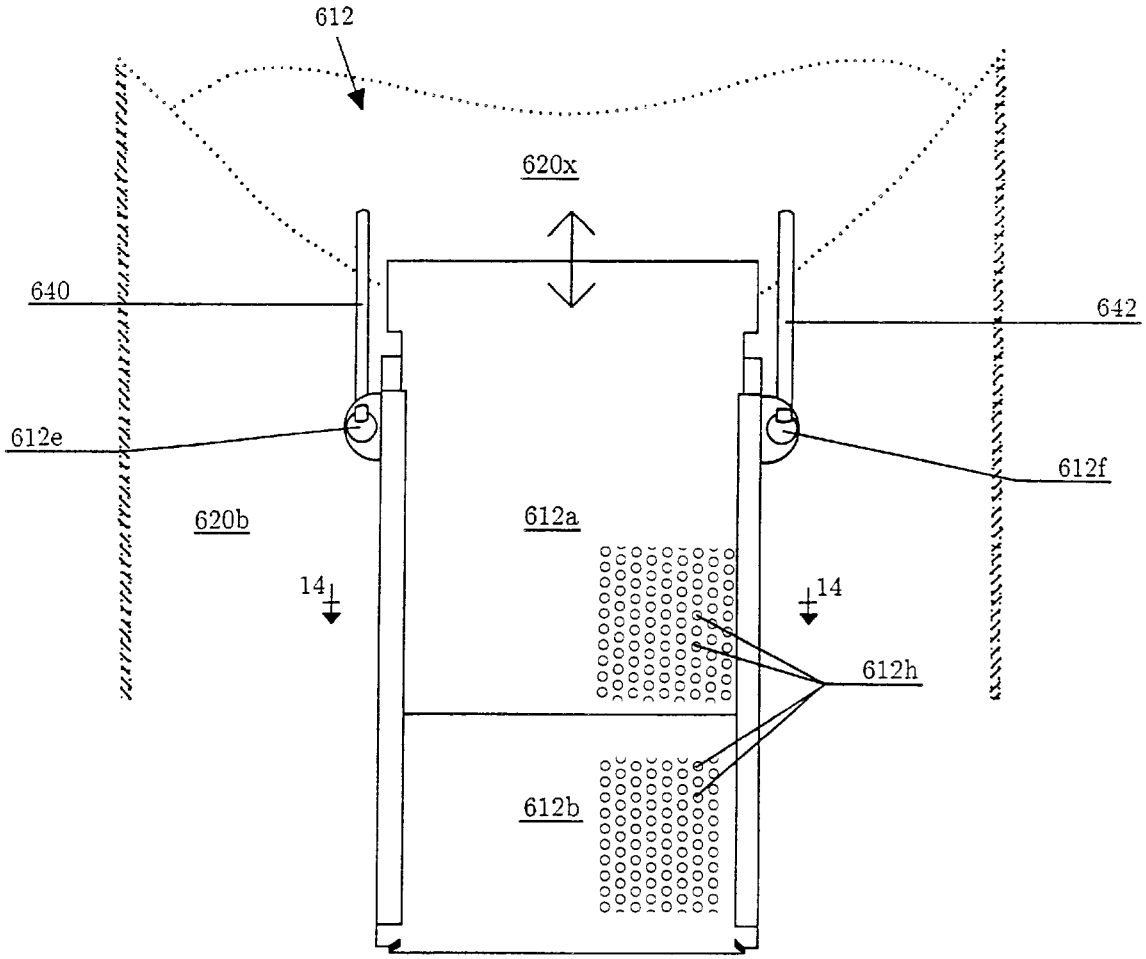
FIG. 13 is an elevation view of a two-part add-on partition, with an upper portion of a pitcher partly out-lined.
Figure 14:
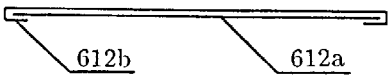
FIG. 14 is a cross-section view taken along line 14—14 of FIG. 13.

As shown in FIGS. 13 and 14, the partition plate may be a two-part partition plate 612 having perforations 612*h*, but different from the two-part partition plate 12 and 12*x* described above in FIG. 1, in that one part 612*a* of the partition plate 612 is slidably mounted into the other part 612*b* of the partition plate, (better shown in FIG. 14), as to be adjustable to the height of a pitcher, such as 620, having an ice bridge 620*x* and a wall 620*b*; whether the two-part partition plate 612 is provided with orifices, openings or perforations with a closed periphery, such as 612*e*, 612*f* engaging each respectively one holding rod or suspending hook 640, 642 mounted onto the ice bridge 620*x*, or projections with each a suction cup such as 12*f*, 12*g*, 30, 32 of FIG. 1 or both, or 620*g*, 620*h*. The partition plate may also be telescopic having more than two parts slidable.

It should be borne in mind that the releasable hook means attributed to a given partition plate in a given FIG., is not limited to that FIG., but may be part of other partition plates: For instance, in a particular embodiment, the orifices, openings or perforations with closed periphery such as 112*o* and 112*p* of FIG. 3, and/or 612*e* and 612*f* of FIG. 13, may be provided each with one of said suction cups defining a projection having a groove as shown in FIG. 2, for receiving one of said tongues shown in FIGS. 3 and 13 defining one of said orifices, openings or perforations with a closed periphery such as 112*o*, 121*p*, 612*e*, 612*f*, and the cup of said suction cups to be releasably mounted to the walls of a pitcher, inside the pitcher.

Figure 15:
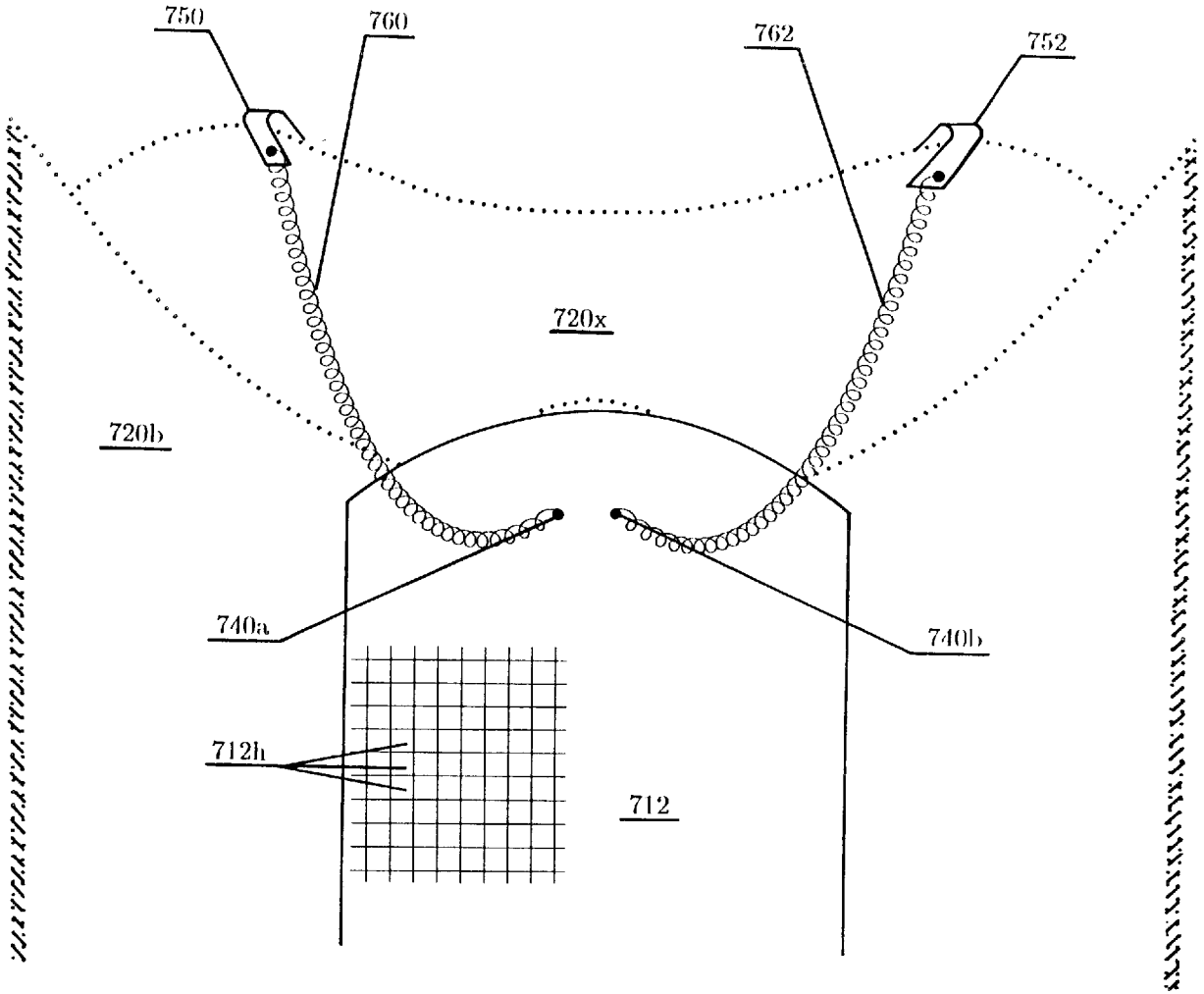
FIG. 15 is an elevation view of an add-on partition with another different releasable hook means attached to the ice bridge of a partly outlined pitcher.

As shown in FIG. 15, in the add-on partition system the elongated partition plate 712 with perforations 712*h*, is provided in a particular case, with perforations, such as 740*a*, 740*b*, and the releasable hook means is at least one pair of clamps 750, 752 and coil springs, 760, 762 each of the coil springs 760, 762 having opposite ends, and for each coil spring, one end is attached to one of the clamps 750, 752, and the other end is attached to the elongated partition plate 712, whereby each coil spring is under torsion. Soldering of the coil springs to the clamps 750, 752 and to the elongated partition plate 712 as well as other fastening devices may be used to secure the coil springs. The clamps 750, 752 are shown attached to the edge of the ice bridge 720*x* of a pitcher having a wall 720*b* extending into said ice bridge 720*x* or to upper parts of the wall 720*b*.

Figure 16:
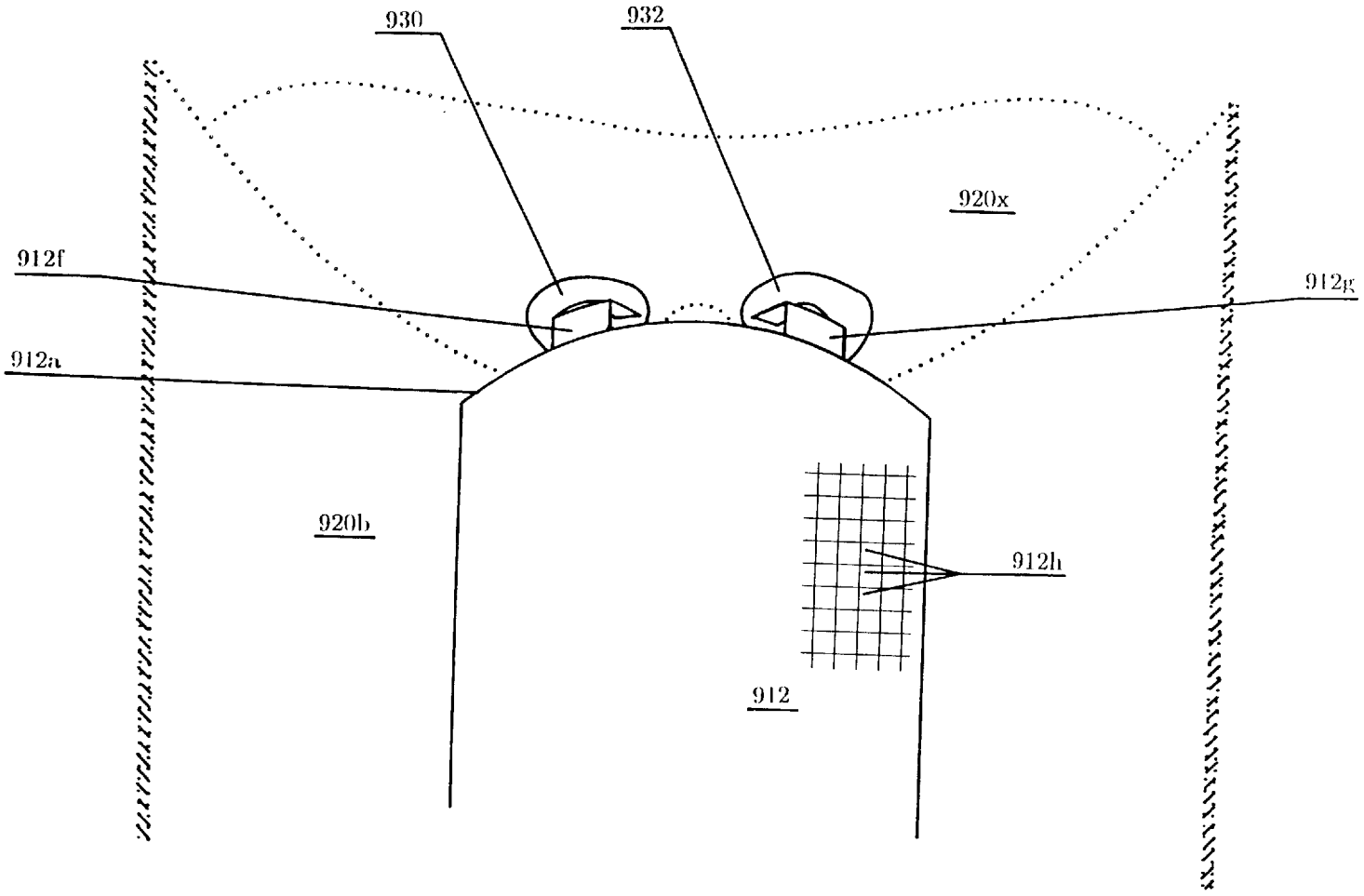
FIG. 16 is an elevation view of another partition plate with a different releasable hook means engaging a partly outlined pitcher.
Figure 17:
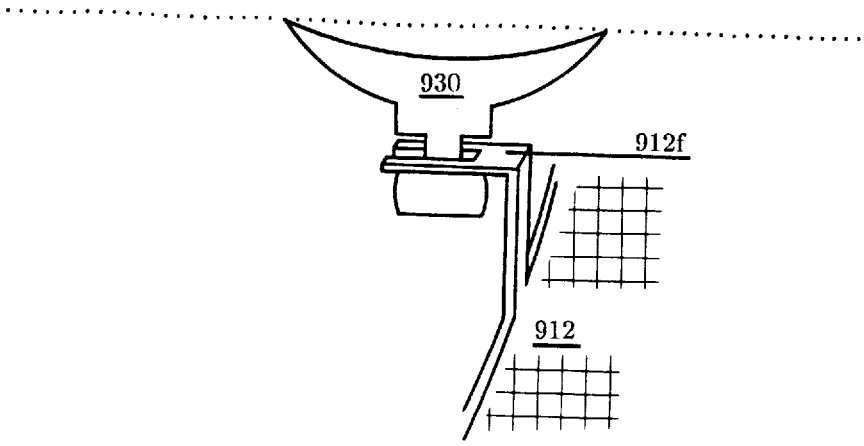
FIG. 17 is a schematic view of one suction cup of FIG. 16 and part of the add-on partition joining the suction cup.

In the add-on partition system as shown in FIGS. 16 and 17, the partition plate 912 with perforations 912*h*, is an elongated rectangular plate defining lateral sides such as 912*a*, and longitudinal sides, and at least one, preferably two, perforated L-shaped tongue, such as 912*f* and 912*g* along one of said lateral sides such as 912*a*, and each tongue cooperates with a suction cup 930, 932, or other attaching means, for holding the L-shaped tongue and retaining the tongues to a pitcher having a wall 920*b* and an ice bridge 920*x*, or via the receiving holes of an ice bridge 920*x* of a pitcher.

Figure 18:
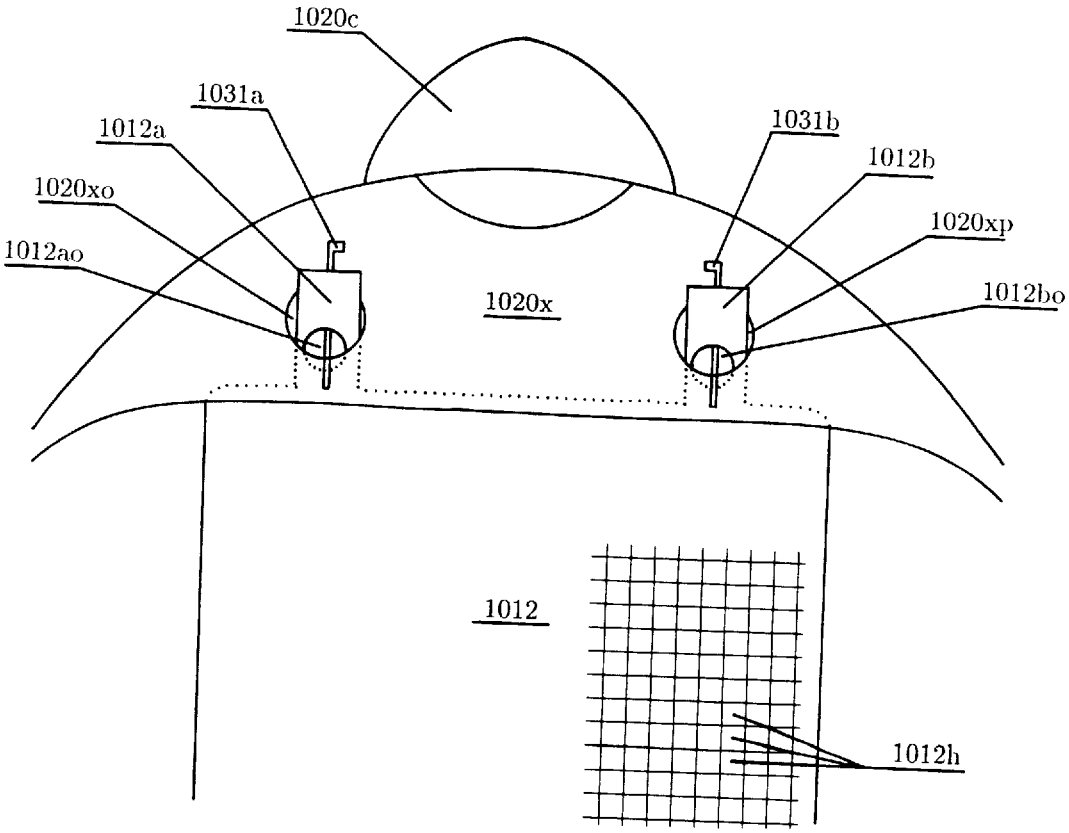
FIG. 18 is an elevation view of an upper portion of another add-on partition with hooks mounted through perforations or orifices on a ice bridge of a pitcher, inside the pitcher having walls terminating into said ice bridge, said ice bridge being solely shown of said pitcher, for sake of clarity.

In FIG. 18, a partition plate 1012 having perforations 1012*h*, defines projections or extensions 1012*a*, 1012*b* and holes or slots 1012ao and 1012bo. The projections or extensions 1012*a*, 1012*b*, are to be received through the ice bridge 1020*x* of a pitcher, via perforations, holes or slots 1020xo and 1020xp provided therefor trough said ice bridge 1020*x*. Retaining pins or other male members 1031*a* and 1031*b* engage respectively holes or slots 1012ao and 1012bo, and extend at each end over the ice bridge 1020*x* adjacent to said holes or slots 1012ao and 1012bo.

An ice bridge is meant to include any top of a pitcher having at least a portion adjacent to a spout.

In a preferred embodiment, the partition plate, runs from the top to the bottom of a pitcher.

It should be noted that the partition plate may be mounted either fixedly or releasably to the releasable hook means, adjacent to at least one of the sides of the plate.

This partition plate may be made from any health compatible material: whether health safe metal, glass or plastic for instance, and similarly for the releasable hook means which must be made from health compatible material.

Preferably, the partition plate which has sides including the longitudinal sides, each of the suction cups is mounted onto the partition plate adjacent to one of the sides.

While some of the preferred embodiments have been described herein above, it is to be understood that the invention is not to be construed as limited to these preferred embodiments, as many modifications and variations are possible within the spirit and scope of the appended claims.

I claim:

1. An add-on partition system to be removably mounted inside a pitcher having a bottom and walls upwardly extending there-from and said walls upwardly extending terminating into an uppermost portion, a portion of said uppermost portion of said walls defining a pouring lip, a portion of said walls upwardly extending being on one side of said pouring lip and spaced therefrom, and another portion of said walls upwardly extending being on the other side of said pouring lip and spaced therefrom, and a portion of said walls upwardly extending being an intermediate portion between said portion of said walls upwardly extending on one side of said pouring lip. and said another portion of said walls upwardly extending on the other side of said pouring lip, and adjacent to said pouring lip, comprising:

an elongated partition plate inside said pitcher, said elongated partition plate having longitudinal sides, said longitudinal sides having a length, and the space between said longitudinal sides defining the width of said elongated partition plate, said elongated partition plate being spaced from said intermediate portion of said walls upwardly extending so as to divide said inside of said pitcher into two zones, one of said two zones being a reservoir zone for quick liquid delivery from said reservoir zone to said pouring lip, one of said longitudinal sides of said elongated partition plate to be held adjacent to said portion of said walls upwardly extending on one side of said pouring lip and distant from said pouring lip, and the other of said longitudinal sides of said elongated partition plate to be held adjacent to said portion of said walls upwardly extending on the other side of said pouring lip and distant from said pouring lip, the length of said longitudinal sides being such that the elongated partition plate extends adjacent from the bottom of the pitcher to said uppermost portion of said walls defining said pouring lip, thus said elongated partition plate defining said two zones inside said pitcher:

said reservoir zone between said elongated partition plate and said intermediate portion of said walls upwardly extending adjacent to said pouring lip.

and a confinement zone for confining any oversize material therein, and releasable hook means, said releasable hook means to be releasably mounted to said walls upwardly extending of said pitcher, inside said pitcher, for releasably holding said elongated partition plate spaced from said intermediate portion of said walls upwardly extending to Provide for said reservoir zone and said confinement zone.

2. The add-on partition system as defined in claim 1, wherein said pitcher has a top, and said partition plate is a perforated rectangular plate for running from the top to the bottom of the pitcher.

3. The add-on partition system as defined in claim 1, wherein said partition plate is a perforated rectangular flat plate, said plate defining opposite lateral sides and said longitudinal sides.

4. The add-on partition system as defined in claim 1, wherein said partition plate is a perforated rectangular plate, said plate defining opposite lateral sides and said longitudinal. sides, and being hemicircularly bent as to obtain substantially U-shaped lateral sides.

5. The add-on partition system as defined in claim 1, wherein said partition plate is a perforated rectangular plate, said plate defining opposite lateral sides and said longitudinal sides, and being bent as to obtain substantially V-shaped lateral sides.

6. The add-on partition system as defined in claim 1, wherein said partition plate is a rectangular plate, said plate defining opposite lateral sides and said longitudinal sides, said plate having a plurality of peripheral cut-off portions along said longitudinal sides.

7. The add-on partition system as defined in claim 1, wherein said partition plate has a plurality of perforations.

8. The add-on partition system as defined in claim 1, wherein said pitcher has a top, and said partition plate is a two-part partition plate consisting of a top part and a bottom part, said top part of said partition plate slidably mounted over said bottom part of said partition plate, as to be an adjustable elongated rectangular plate for running from the top to the bottom of the pitcher.

9. The add-on partition system as defined in claim 1, wherein said partition plate is an elongated rectangular plate having a symmetrical longitudinal axis, said partition plate defining lateral sides, said longitudinal sides, and at least one U-shaped tongue along each of said longitudinal sides, said tongues being symmetrically disposed with respect to the symmetrical longitudinal axis of said rectangular plate in pairs.

and said releasable hook means is a pair of suction cups, each of said suction cups defining a projection having a groove for receiving therein one of said U-shaped tongues, and the cup of said suction cups to be releasably mounted to the walls of said pitcher, inside said pitcher.

10. The add-on partition system as defined in claim 1, wherein said partition plate is a rectangular plate having a symmetrical longitudinal axis and at least one tongue along each of said longitudinal sides, said tongues being symmetrically disposed with respect to the symmetrical longitudinal axis of said rectangular plate in pairs, and defining each a perforation with a closed periphery, and said releasable hook means is a pair of suction cups, each of said suction cups defining a projection having a groove, for receiving one of said tongues, in one of said perforations with a closed periphery, and the cup of said suction cups to be releasably mounted to the walls of said pitcher, inside said pitcher.

11. The add-on partition system as defined in claim 1, wherein said partition plate has sides including said longitudinal sides, and said releasable hook means is a pair of suction cups, each of said suction cups is mounted onto the partition plate, adjacent to one of said sides.

12. The add-on partition system as defined in claim 1, for a magnetic pitcher, wherein said partition plate defines at least one magnetic portion, said releasable hook means being said at least one magnetic portion.

13. The add-on partition system as defined in claim 1, wherein the pitcher has a magnetic portion, and wherein said partition plate is provided with perforations, said releasable hook means is at least one pair of magnets terminating into a suspending hook, said suspending hooks engaging one of said perforations of said partition plate, said magnets for engaging said magnetic portion of said pitcher.

14. The add-on partition system as defined in claim 1, wherein said partition plate is a rectangular plate having a symmetrical longitudinal axis and at least one tongue along each of said longitudinal sides, said tongues being symmetrically disposed with respect to the symmetrical longitudinal axis of said rectangular plate in pairs, and defining each a perforation with a closed periphery, and said releasable hook means is a pair of suction cups, each of said suction cups terminating into a suspending hook, said suspending hooks engaging one of said perforations with a closed periphery, and thereby holding one of said tongues, the cup of said suction cups to be releasably mounted to the walls of said pitcher, inside said pitcher.

15. The add-on partition system as defined in claim 1, for the pitcher having said wall extending into an ice bridge, wherein said releasable hook means is at least one pair of suspending hooks having an outwardly threaded end, and a nut threadedly mounted onto said threaded end, and said ice bridge of said pitcher has at least two perforations, whereby said one threaded end of said suspending hooks is able to engage one of said perforations and be held therein with said nut.

16. The add-on partition system as defined in claim 1, for the pitcher having said wall extending into an ice bridge, wherein said releasable hook means is at least one pair of suspending hooks having a threaded end, and said ice bridge of said pitcher has at least two threaded perforations, whereby said one threaded end of said suspending hooks is able to engage one of said threaded perforations of said ice bridge and be held therein.

17. The add-on partition system as defined in claim 1, for the pitcher having said wall extending into an ice bridge, wherein said releasable hook means is at least one pair of suspending hooks having a female threaded end, and a bolt to be threadedly mounted into said female threaded end, and said ice bridge of said pitcher has at least two perforations, whereby said one threaded end of said suspending hooks is able to engage one of said perforations and be held therein with said bolt.

18. The add-on partition system as defined in claim 1, wherein said releasable hook means is at least one pair of clamps and of coil springs, each of said coil springs having opposite ends, and for each coil spring, one end being attached to one of said clamps and the other end being attached to said elongated plate, whereby each coil spring is under torsion.

19. The add-on partition system as defined in claim 1, wherein said partition plate defines a truncated-cone shaped plate, said cone shaped plate having a truncated apex and a base, and being cut out by an imaginary plane running from said truncated apex to said base as to define opposite longitudinal sides.

20. The add-on partition system as defined in claim 1, wherein said partition plate defines a truncated-cone shaped plate, said cone shaped plate having a truncated apex and a base, and being cut out by an imaginary plane running from said truncated apex to said base as to define opposite longitudinal sides, said plate is unperforated, and said opposite longitudinal sides having a plurality of cut-out arches.

* * * * *